United States Patent [19]

Highfield et al.

[11] Patent Number: 4,643,062

[45] Date of Patent: Feb. 17, 1987

[54] ROTARY DIE CUTTING MACHINE

[75] Inventors: James H. Highfield, Sedgley Hall Estate; Roy Pugh, Birmingham, both of England

[73] Assignee: Kirby's Engineers, Ltd., West Midlands, England

[21] Appl. No.: 770,347

[22] Filed: Aug. 28, 1985

[51] Int. Cl.[4] ..... B26F 1/42

[52] U.S. Cl. ..... 83/285; 83/284; 83/292

[58] Field of Search ..... 83/155, 284, 510, 512, 83/285, 289, 290–292; 100/172; 474/149

[56] References Cited

U.S. PATENT DOCUMENTS

| | | | |
|---|---|---|---|
| 2,168,400 | 8/1939 | Evers | 83/284 X |
| 2,319,896 | 5/1943 | Winkley | 83/284 |
| 2,643,475 | 6/1953 | Klopfenstein | 100/172 X |
| 2,776,510 | 1/1957 | Klopfenstein | 100/172 X |
| 3,140,620 | 7/1964 | Ferara | 474/149 X |
| 3,199,390 | 8/1965 | Arnould et al. | 83/544 X |
| 3,301,110 | 1/1967 | Stegner | 83/284 X |
| 3,643,518 | 2/1972 | Semin et al. | 474/149 X |
| 3,808,925 | 5/1974 | Harps | 83/346 |
| 3,965,786 | 6/1976 | Dluhy | 83/346 |
| 4,182,208 | 1/1980 | Bruno et al. | 83/118 |
| 4,455,903 | 6/1984 | Kesten | 83/346 |

OTHER PUBLICATIONS

Paperboard Packaging, Aug. 1984.

*Primary Examiner*—James M. Meister
*Attorney, Agent, or Firm*—Edward H. Renner

[57] ABSTRACT

A rotary die cutter for cutting sheet material has a drive mechanism which reduces the shock applied between the work piece and the die. Including a drive train for the die cutting rollers which permits slippage. The drive train can have a tension belt system which allows slippage when excessive force is required at the die so that the shock on the prime mover and drive train is minimized.

16 Claims, 12 Drawing Figures

ROTARY DIE CUTTING MACHINE

BACKGROUND AND SUMMARY

This invention relates to die cutting machines. In particular, the invention relates to die cutting adapted to cut patterns from sheet material such as veneers, boxboard, plastic sheeting or any material in sheet or strip form.

It has previously been known to cut sheet material using dies mounted on clam shell or reciprocating presses. Due to the essentially uniform contact between the work piece and the dies, the operation of the machine is limited by the size of the cut. Essentially, increasing the linear distance of the cut requires successively more power due to the essentially uniform or all at once operation of the cut.

To overcome these limitations in reciprocating and clam shell presses, the industry has turned more and more to rotary die cutting systems, that is, those systems which can apply a differential pressure to the die by incrementally cutting the strip or sheet as it is passed underneath the die and over a supporting anvil. Since the cutting is progressive, the machine is not as restricted to the linear size of the cut or die which is used.

U.S. Pat. Nos. 3,808,925; 3,965,786; 4,182,208; 4,455,903 exemplify rotary die cutting systems for sheets and strips. The disclosures of the above patents are incorporated by reference herein.

While rotary die cutting systems offer the possibility of incremental or differential cutting of the die into the work piece, and thus are not as limited in the size of the cut which can be used, the increasing linear size of a cut does impose some problems. Particularly, when a large cut must be made transverse to the direction of travel of the work piece through the die. Such large cuts require a significantly greater incremental force applied to the die. This greater force which is required must be generated at the die and, of course, ultimately is transmitted to the die through the drive train of the die cutting system from the prime mover. The drive train and mechanism of the die cutting must be sufficiently strong to withstand the shock imposed by the sudden incremental force required and the drive train and prime mover must be strong enough to develop and transmit that force. As will be appreciated, these components of the system must either be over designed to tolerate this shock of incremental force or the entire system risks failure as a result of breakage of the drive train and prime mover.

It is an object of this invention to provide a rotary die cutting system which effectively cuts sheet material.

It is a further object of this invention to provide a rotary die cutter which can effectively cut large lineal distances and maintain the register of the system.

It is a further object of the invention to provide a rotary die system which does not require an over design of the drive train and prime mover and which minimizes shock to those components when instantaneously making long lineal cuts.

It is a further object of this invention to provide a rotary die cutting system which can apply a reduced shock force.

The invention will be further understood from the following Description of the Drawings and Description of the Preferred Embodiments.

DETAILED DESCRIPTION OF THE PREFERRED EMBODIMENT

Figures 1, 11, 12:
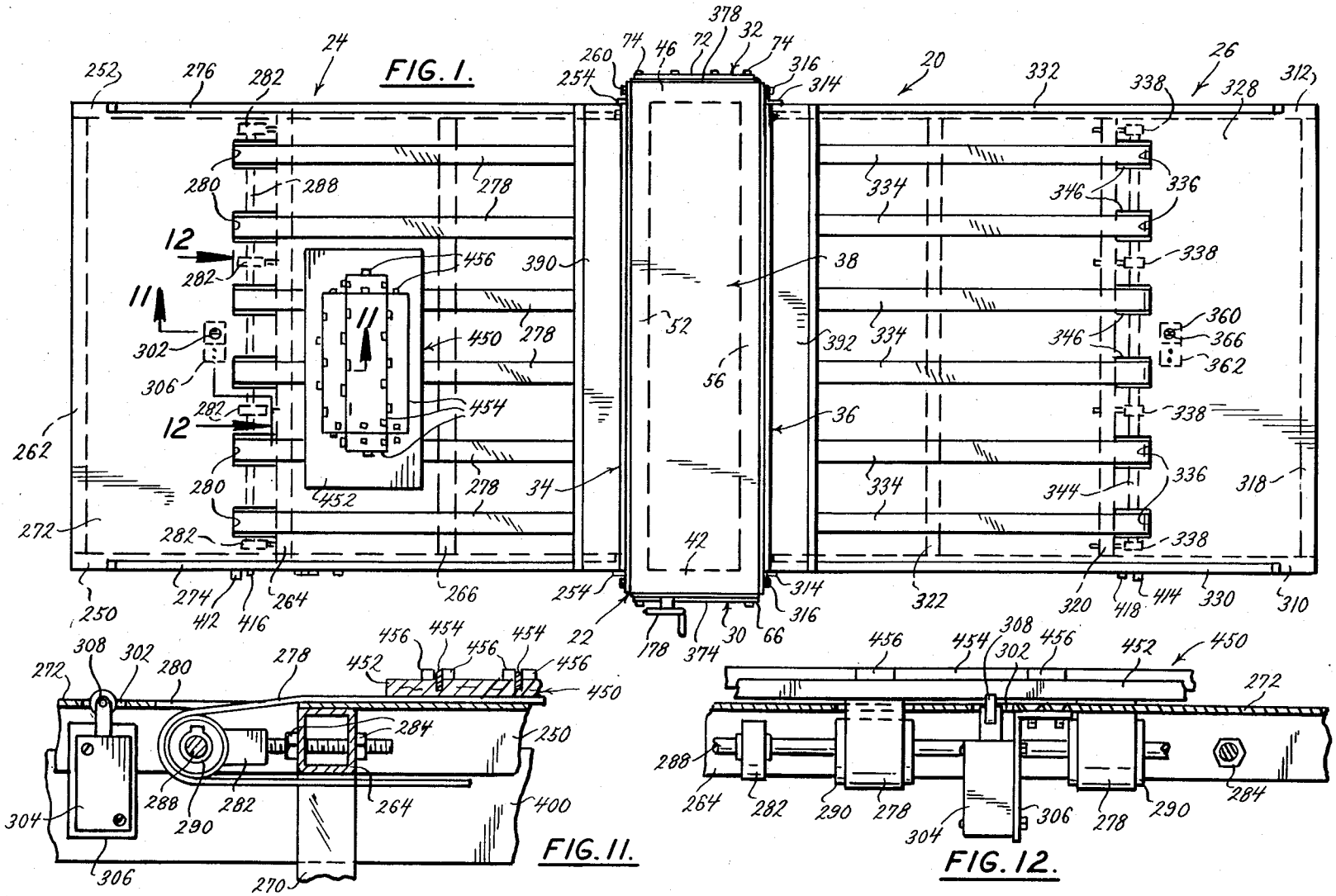
FIG. 1 is a top plan view of a die cutter constructed according to the principles of this invention.
FIG. 11 is a partial cross-sectional view of the die cutter taken along the plane of line 11—11 in FIG. 1, showing the feed belts and the position sensor.
FIG. 12 is a partial cross-sectional view of the die cutter taken along the plane of line 12—12 in FIG. 1, showing the feed belts.

A die cutter constructed according to the principles of this invention is indicated generally as 20 in the Figures. Die cutter 20 comprises a central roller unit 22, front table 24, and rear table 26.

Central roller unit 22 comprises a generally rectangular prism-shaped frame 28 having right and left sides 30 and 32, front 34, rear 36, and top 38. The frame 28 is constructed from square-cross-section metal tubing. The right side 30 of frame 28 comprises two vertical columns 40, a top crossmember 42 and a bottom crossmember 44. The left side 32 of frame 28 comprises two vertical columns 46, a top crossmember 48, and a bottom crossmember (not shown) similar to bottom crossmember 44. The front 34 of frame 28 comprises top and bottom transverse members 52 and 54 extending between right side 30 and left side 32. The rear 36 of frame 28 comprises top transverse member 56 and a bottom transverse member (not shown) similar to bottom transverse member 54, these transverse members extending between right side 30 and left side 32.

Figures 4, 5:
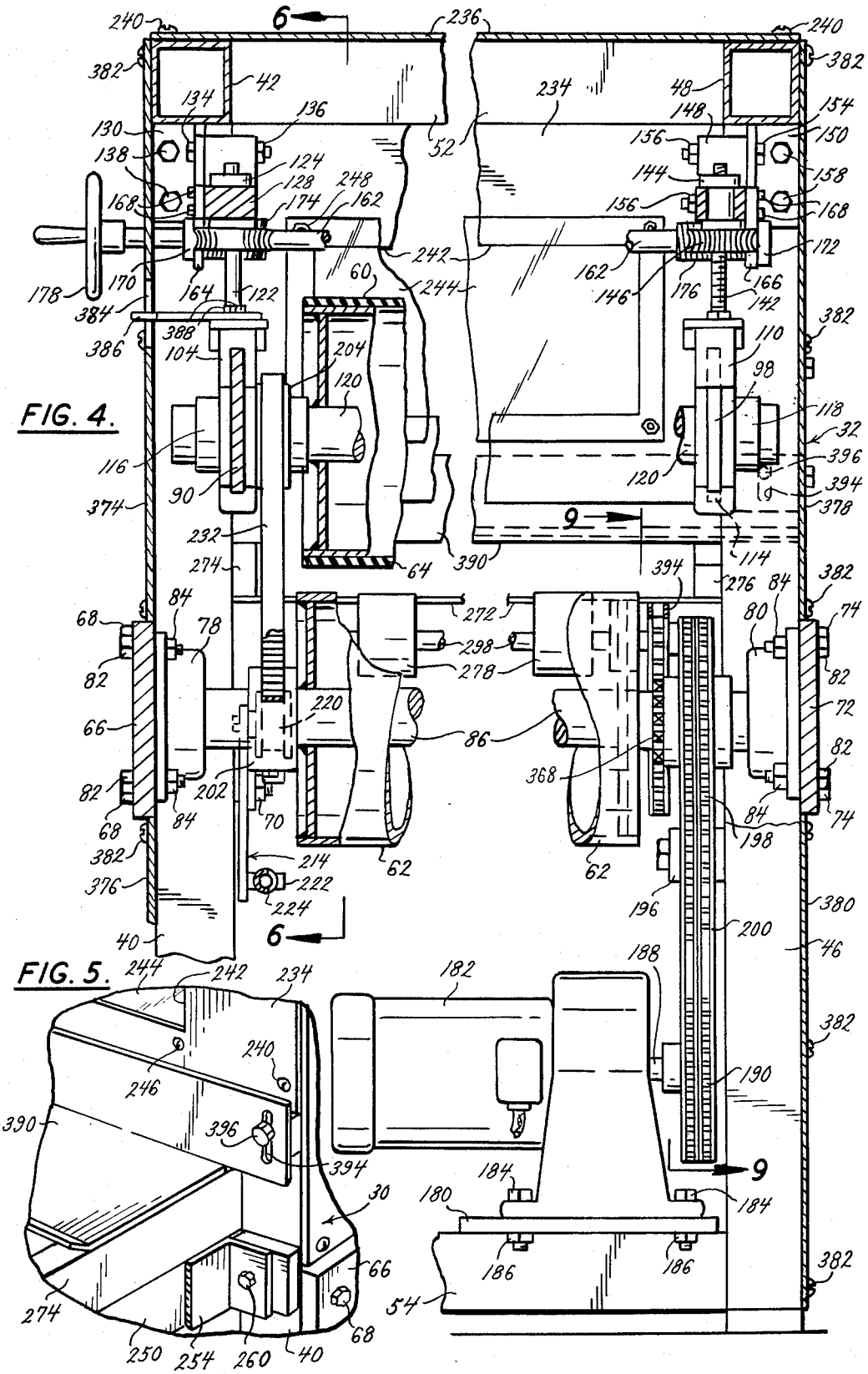
FIG. 4 is a partial cross-sectional view of the die cutter taken along the plane of line 4—4 in FIG. 1, showing the central roller unit.
FIG. 5 is a partial perspective view of the right side of the die cutter showing the attachment of the central roller unit to the front table.

An upper roller 60 and lower roller 62 are mounted generally parallel, one above the other, in frame 28. Roller 60 is the cutter roller, and thus may be provided with a resilient cover 64, as shown in FIG. 4, for receiving the cutting blades of the dies. In the preferred embodiment, cover 64 can be a sleeve made from PVC pipe and lathed to a circular cross-section.

Figure 8:
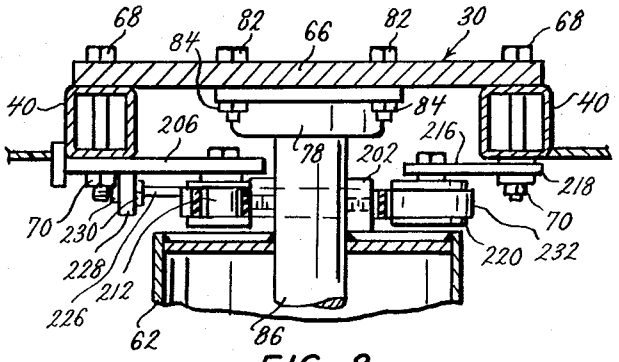
FIG. 8 is a partial cross-sectional view of the die cutter taken along the plane of line 8—8 in FIG. 7, showing the mounting of the lower roller.
Figure 7:
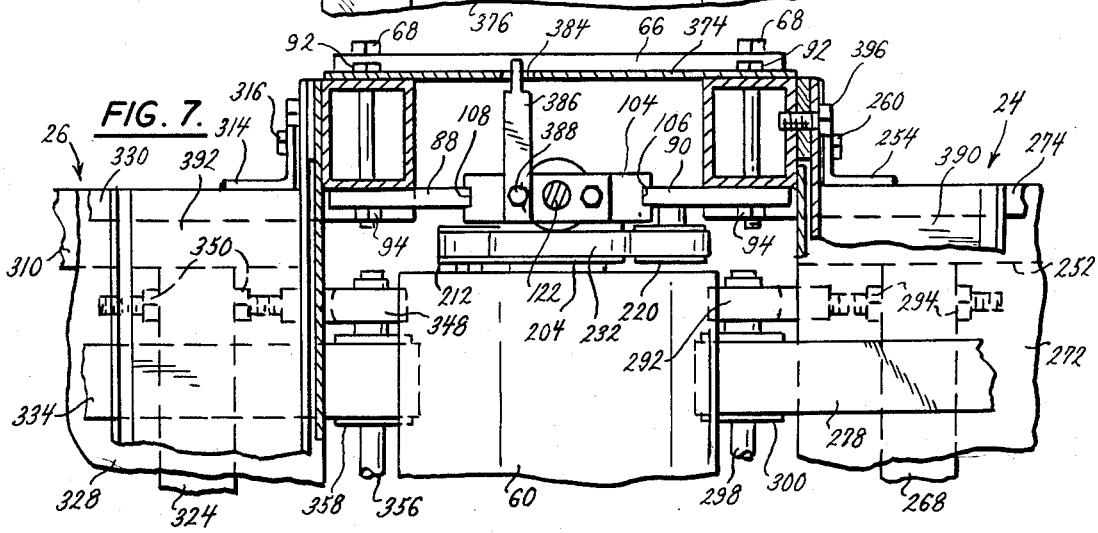
FIG. 7 is a partial cross-sectional view of the die cutter along the plane of line 7—7 in FIG. 6.
Figure 10:
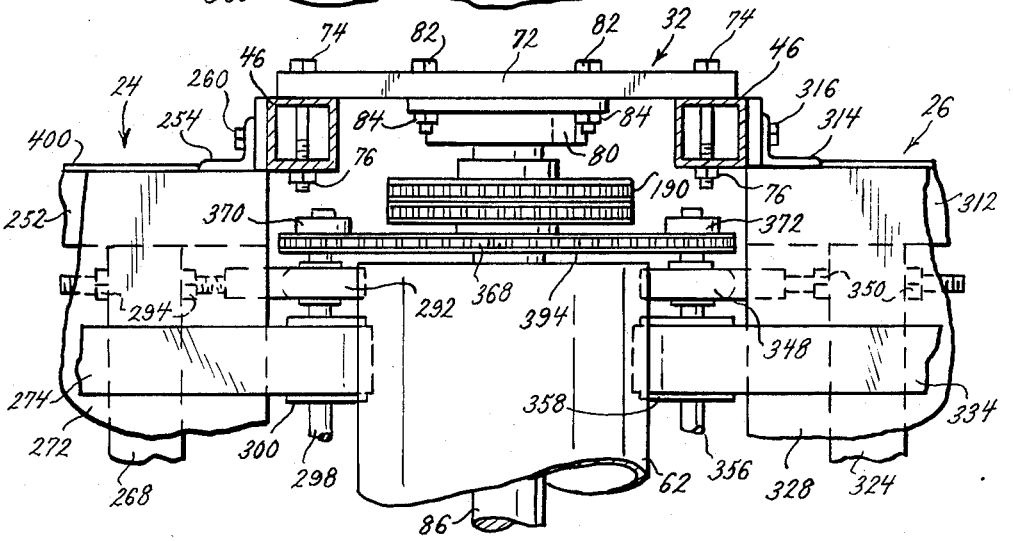
FIG. 10 is a partial cross-sectional view of the die cutter taken along the plane of line 10—10 in FIG. 9 showing the drive mechanism for the lower roller.

Lower roller 62 is mounted in frame 28 as follows: As best shown in FIGS. 7 and 8, a right mounting plate 66 is mounted between columns 40 on the right side 30 of frame 28, as with bolts 68 and nuts 70. As best shown in FIG. 10, a left mounting plate 72 is mounted between columns 46 on the left side 32 of frame 28, with bolts 74 and nuts 76. As best shown in FIG. 4, bearing housings 78 and 80 are mounted to the inner sides of plates 66 and 72, respectively, with bolts 82 and nuts 84. A shaft 86 is rotatably mounted between the bearings (not shown) in bearing housings 78 and 80. Lower roller 62 is mounted on shaft 86.

Figure 6:
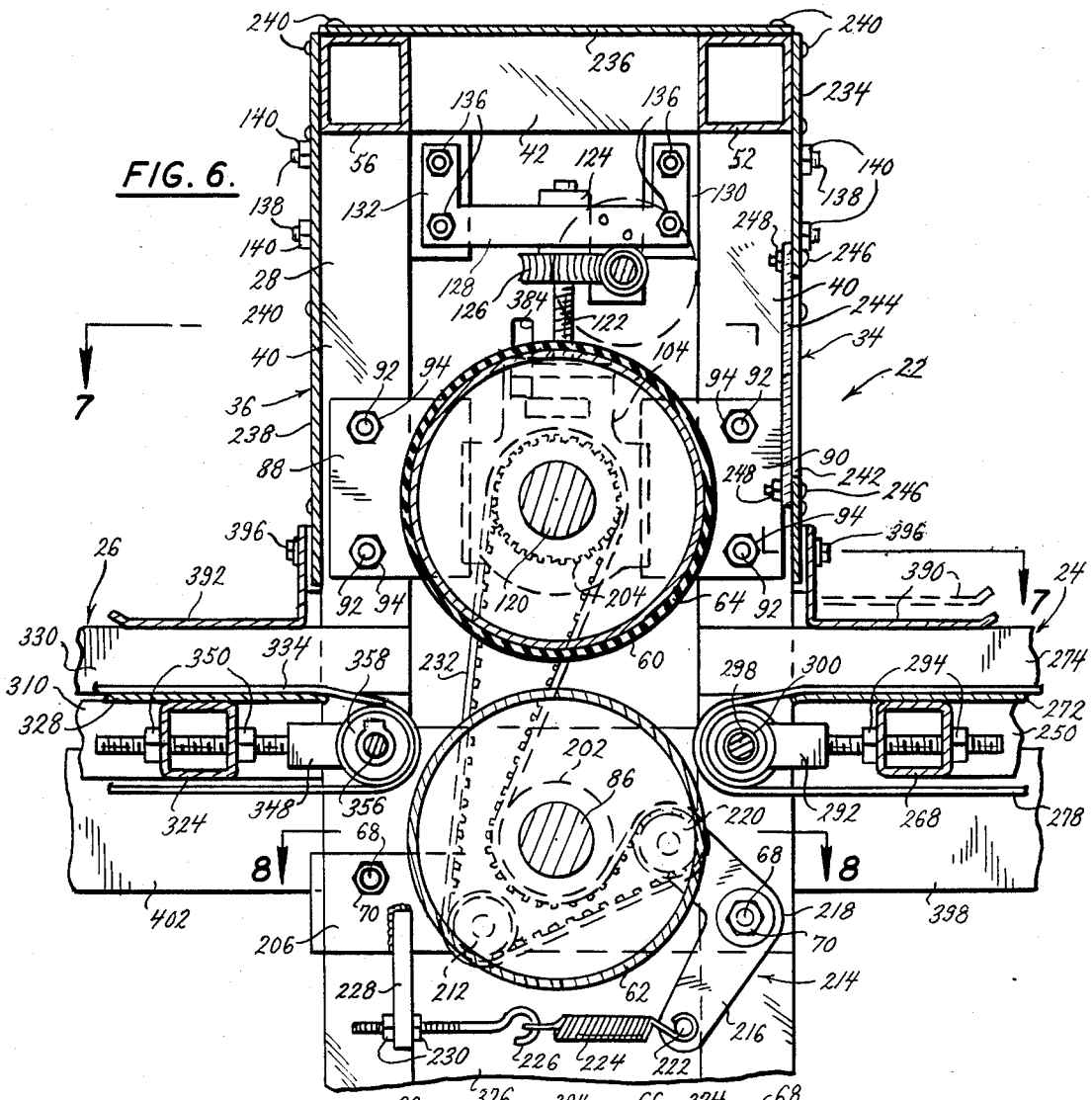
FIG. 6 is a partial cross-sectional view of the die cutter along the plane of line 6—6 in FIG. 4, showing the opposing rollers.

Upper roller 60 is mounted in frame 28 as follows: As best shown in FIG. 6, front and rear track members 88 and 90 are mounted on the inside side of columns 40 on the right side 30 of frame 28, with bolts 92 and nuts 94. Similarly, a front track member (not shown) and a rear track member 98 are mounted on the inside side of columns 46 on the left side 32 of frame 28, with bolts and nuts. A right mounting block 104, having vertical grooves 106 and 108 in its front and rear edges, is mounted between front and rear track members 88 and 90, as best shown in FIG. 7, with the grooves 106 and 108 receiving the track members 88 and 90. Similarly a left mounting block 110, having a vertical groove in its front edge (not shown) and a vertical groove 114 in its rear edge, is mounted between the front and rear track members on the left side, with the grooves receiving the track members. Blocks 104 and 110 are vertically slidable in their respective tracks.

Bearings 116 and 118 are mounted in blocks 104 and 110, respectively. Shaft 120 is rotatably mounted in bearings 116 and 118. Upper roller 60 is mounted on shaft 120.

The blocks 104 and 110 are supported by a special mounting structure that allows the blocks 104 and 110 to be simultaneously moved up or down to keep the shaft 120 mounted between them level. A threaded support rod 122 is threaded into the top of block 104. A collar 124 is mounted on the top of rod 122. A gear 126 is also mounted on rod 122, just below collar 124. Collar 124, and thus rod 122, is rotatably mounted in the bottom of a generally U-shaped brace 128. Brace 128 is mounted on the right side 30 of frame 28, near the top brace 28. Front and rear L-shaped mounting brackets 130 and 132 are engaged to the front and rear ends, respectively, of brace 128 with the bolts 134 and nuts 136. Brackets 130 and 132 are engaged to columns 40 with bolts 138 and nuts 140.

Block 110 is supported similarly to block 104. A threaded support rod 142 is threaded into the top of block 110. A collar 144 is mounted on the top of rod 142. A gear 146 is also mounted on rod 142, just below collar 144. Collar 144, and thus rod 142, is rotatably mounted in the bottom of a generally U-shaped brace 148. Brace 148 is mounted on the left side 32 of frame 28, near the top. Front L-shaped mounting bracket 150 and rear L-shaped mounted bracket (not shown), are engaged to the front and rear ends, respectively, of brace 148 with bolts 154 and nuts 156. The front bracket 150 and the rear bracket are engaged to columns 46 with bolts 158 and nuts (not shown).

A transverse shaft 162 is rotatably mounted in arms 164 and 166 depending from braces 128 and 148, respectively, the arms being secured with screws 168. Shaft 162 has two shoulders 170 and 172 on the external sides of arms 164 and 166, respectively, to hold shaft 162 axially in place. Two worm gears 174 and 176 are mounted on shaft 162 in engagement with gear 126 on rod 122 and gear 146 on rod 142. A crank 178 is mounted on the right end of shaft 162. Crank 178 can be turned to turn shaft 162 to simultaneously turn mounting rods 122 and 142 to thread into or out of blocks 104 and 110. Thus shaft 120 and upper roller 60 thereon can be raised or lowered without tilting.

Figure 9:
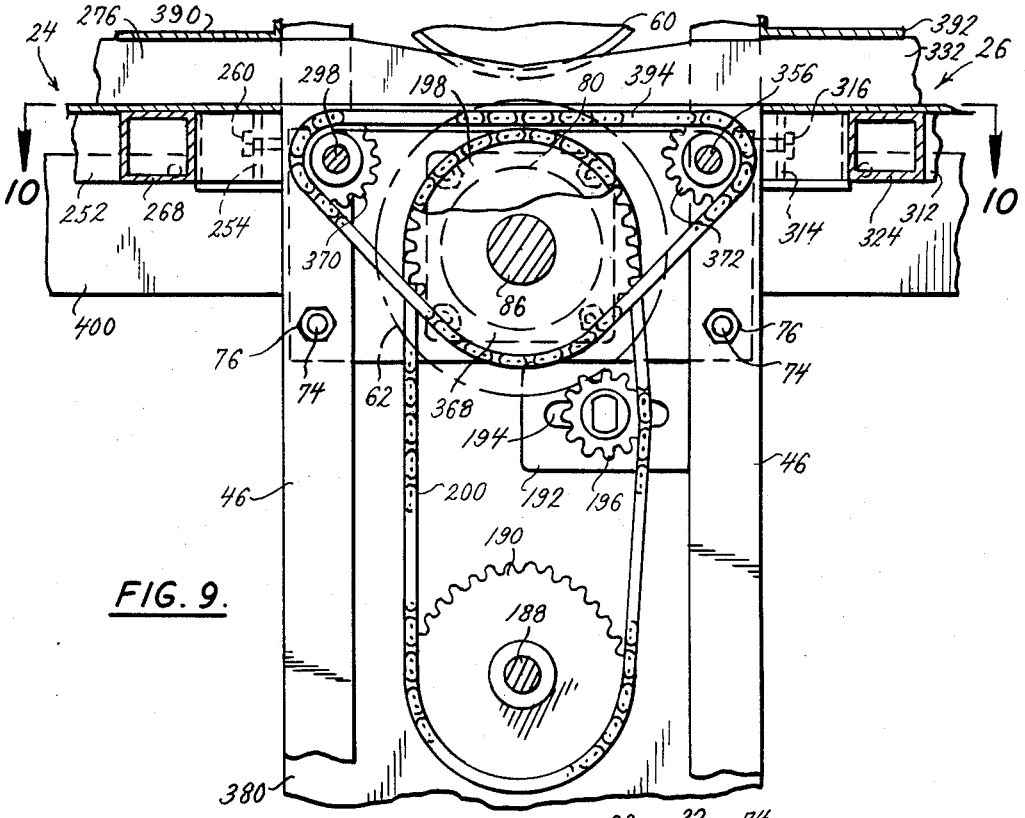
FIG. 9 is a partial cross-sectional view of the die cutter taken along the plane of line 9—9 in FIG. 4, showing the drive mechanism.

The drive mechanism for the rollers 60 and 62 is best shown in FIG. 4. A motor mounting plate 180 mounted to the bottom of frame 28, near left side 32, between the front lower transverse member 54 and the rear, lower transverse member (not shown). A reversible motor 182 is mounted on plate 180 with bolts 184 and nuts 186. A drive shaft 188 extends from motor 182. A toothed double drive sprocket 190 is mounted on drive shaft 188. As best shown in FIG. 9, arm 192 extends inwardly from one of the columns 46. Arm 192 has a horizontal transverse slot 194. A double idler sprocket 196 is pivotally mounted in slot 194. The sprocket 196 can be adjustably positioned along the length of slot 194. A double toothed sprocket 198 is mounted on shaft 86, to the left of lower roller 62. A double chain loop 200 extends around drive sprocket 190, around idler sprocket 196, and around sprocket 198. Idler sprocket 196 is adjustable in slot 194 to maintain the proper tension in loop 200. Motor 182 thus drives shaft 86 and lower roller 62. The upper roller 60 and the feed belts described below are all driven from shaft 86.

The drive mechanism for upper roller 60 is best shown in FIG. 6. A drive hub 202 is mounted on shaft 86, to the right of lower roller 62. A toothed sprocket 204 is mounted on shaft 120, to the right of upper roller 60, and generally above drive hub 202. An arm 206 extends along the right side 32 of frame 28 and is mounted to the inside of one of the columns 40 with a bolt 68 and nut 70 which also secures plate 66. An idler sprocket 212 is rotatably mounted on arm 206 generally below and behind hub 202 on shaft 86. A tensioning unit 214 is mounted inside the right side 30 of frame 28. As best shown in FIGS. 6 and 8, tensioning unit 214 comprises an L-shaped lever 216 pivotally mounted at the vertex 218 to the inside of a column 40 by a bolt 68 and nut 70 which also secures plate 66. An idler sprocket 220 is rotatably mounted at one end of lever 216. A stud 222 is mounted at the other end of lever 216. One end of a coil spring 224 is engaged to stud 222, and the other end of the spring is engaged by a hook 226. The end of hook 226 is threaded, and this threaded end is adjustably engaged in a bracket 228, depending from arm 206, with nuts 230.

As best shown in FIG. 6, a flexible belt 232 having a toothed internal side and a smooth external side is mounted in a generally L-shaped loop over toothed sprocket 204, idler sprocket 212, and idler sprocket 220, but around drive hub 202. Tensioning unit 214 operates to hold the external side of belt 232 against drive hub 202 so that hub 202 can frictionally drive belt 232 and thus drive the shaft 120 and upper roller 60 mounted thereon. Because there is only frictional engagement between drive hub 202 and belt 232, belt 232 can slip as required to permit upper roller 60 to slip relative to lower roller 62 to accommodate cutting dies and blanks passing between the upper roller 60 and lower roller 62. Tensioning unit 214 helps to keep belt 232 in engagement with hub 202, even when the upper roller 60 is moved upwardly or downwardly.

As best shown in FIG. 6, central roller unit 22 is covered in the front 34, top 38, and rear 36 with a front panel 234, a top panel 236, and rear panel 238 secured with screws 240. Front panel 234 has a rectangular window 242 therein. A transparent window pane 244 can be secured over window 242 with screws 246 and nuts 248.

Front table 24 is connected to the front 34 of frame 28 of central roller unit 22. Front table 24 comprises right and left side members 250 and 252 connected at their rearward ends to the front 34 of frame 28 with L-shaped brackets 254 which are secured to frame 28 with bolts 260. A front crossmember 262 extends transversely between the front ends of side members 250 and 252. Three additional crossmembers 264, 266, and 268 extend transversely between side members 250 and 252. A leg 270 is mounted to each side member 250 and 252, to support front table 24. A top surface 272 is mounted over side members 250 and 252 and crossmembers 262, 264, 266 and 268. Right and left side rails 274 and 276 are mounted on top surface 272.

As best shown in FIG. 1, in the preferred embodiment, six feed belts 278 extend over the top surface 272 of front table 24. A hole 280 is provided in top surface 272 for each belt 278. Four supports 282 having threaded rods extending therefrom are mounted extending forwardly from crossmember 264 with nuts 284. A roller bearing (not shown) is mounted in each support 282. A transverse shaft 288 is rotatably mounted in the bearings in supports 282. Six hubs 290, one corresponding to each belt 278, are mounted on shaft 288. Hubs 290 extend generally below holes 280. Near the rear end of front table 24, as shown in FIGS. 6 and 7, four supports 292 having threaded rods extending therefrom are mounted extending rearwardly from cross-member 268, with nuts 294. A bearing (not shown) is mounted in each support 292. A transverse shaft 298 is rotatably mounted in the bearings in support 292. Six hubs 300, one corresponding to each belt 278, are mounted on shaft 298. Hubs 300 extend generally beyond the rearward edge of top surface 272. As shown in FIGS. 1 and 11, and 6 and 7, each belt 278 extends over a hub 290 and a hub 300, extending both over and under top surface 272.

As shown in FIGS. 11 and 12, a hole 302 is provided on top surface 272 near the front. A position sensor 304 is mounted to the underside of surface 272, below hole 302, with a generally L-shaped bracket 306. A wheeled actuator arm 308 of sensor 304 extends upwardly through hole 302, above surface 272.

Rear table 26 is connected to the rear 36 of frame 28 of central roller unit 22, and is virtually a mirror image of front table 24. Rear table 26 comprises right and left side members 310 and 312 connected at their forward ends to the rear 36 of frame 28 with L-shaped brackets 314 which are secured to frame 28 with bolts 316. A rear cross-member 318 extends transversely between the rear ends of side members 310 and 312. Three additional cross-members 320, 322, and 324 extend transversely between side members 310 and 312. A leg 326 is mounted to each side member 210 and 312, to support rear table 26. A top surface 328 is mounted over side members 310 and 312, and cross-members 318, 320, 322, and 324. Right and left side rails 330 and 332 are mounted on top surface 328.

As best shown in FIG. 1, in the preferred embodiment, six feed belts 334 extend over the top surface 328 of rear table 26. A hole 336 is provided in top surface 328 for each belt 334. Four supports 338 having threaded rods extending therefrom are mounted extending rearwardly from cross-member 320 with nuts (not shown). A roller bearing (not shown) is mounted in each support 338. A transverse shaft 344 is rotatably mounted in the bearings in supports 338. Six hubs 346, one corresponding to each belt 334, are mounted on shaft 344. Hubs 346 extend generally below holes 336. Near the front end of rear table 26, as shown in FIGS. 6 and 7, four supports 348 having threaded rods extending therefrom are mounted extending forwardly from crossmember 324 with nuts 350. A roller bearing (not shown) is mounted in each support 348. A transverse shaft 356 is rotatably mounted in the bearings in supports 348. Six hubs 358, one corresponding to each belt 334, are mounted on shaft 356. Hubs 358 extend generally beyond the forward edge of top surface 328. As shown in FIG. 1 and in FIGS. 6 and 7, each belt 334 extends over a hub 346 and 358, extending both over and under surface 328.

As best shown in FIG. 1, a hole 360 is provided in top surface 328 near the rear. A position sensor (not shown) is mounted to the underside of surface 328, below hole 360 with a generally L-shaped bracket 362. A wheeled actuator arm 366 of the sensor extends upwardly through hole 360, above surface 328.

A toothed sprocket 368 is mounted on shaft 86, between sprocket 198 and lower roller 62. A toothed sprocket 370 is mounted on shaft 298. A toothed sprocket 372 is mounted on shaft 356. A chain loop 394 is mounted over sprocket 368, sprocket 370, and sprocket 372. Shaft 86 thus drives belts 278 and 336 in unison with each other and with lower roller 62 mounted on shaft 86.

The sides 30 and 32 of frame 28 are covered with upper and lower right side panels 374 and 376, and upper and lower left panels 378 and 380, all secured to the frame 28 with screws 382. Upper right panel 374 has a vertically extending slot 384 therein for receiving an indicator 386 mounted to the top of block 104 with a screw 388. Indicator 386 gives an indication of the position of upper roller 60. A front and rear shields 390 and 392 are mounted across the front 34 and rear 36 of frame 28. Shields 390 and 392 have a generally L-shaped cross-section with a portion extending horizontally over tables 24 and 26, respectively. As shown in FIG. 5, the vertical portion of each shield 390 and 392 has a vertical slot 394 therein. The shields are adjustably secured to the frame with bolts 396 extending through the slots 394 and into the frame 28. Slots 394 allow the shields 390 and 392 to be raised or lowered.

Figure 3:
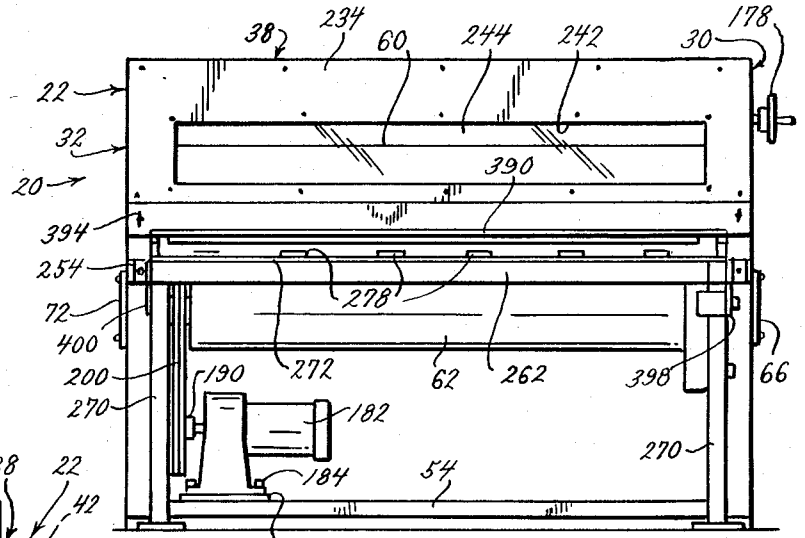
FIG. 3 is a front end elevation view of the die cutter.

As best shown in FIGS. 1 and 3, right and left front panels 398 and 400 extend along the sides of front table 24. Similarly a right rear panel 402 and a left rear panel (not shown) extend along the sides of rear table 26.

Figure 2:
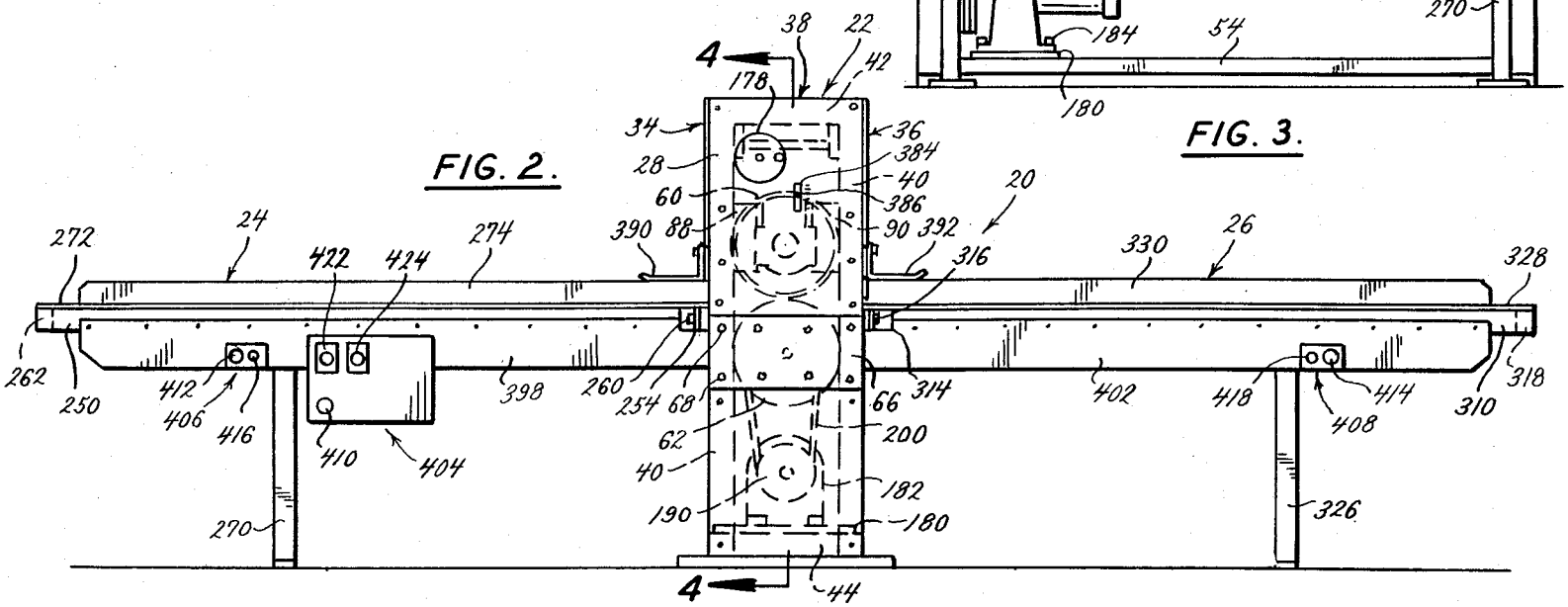
FIG. 2 is a right side elevation view of the die cutter.

The control system for die cutter 20 is best illustrated in FIG. 2 as comprising a central control unit 404, a front start/stop control 406, and a rear start/stop control 408. A master power switch 410 is mounted on central control unit 404. The master power switch 410 must be in the "on" position for power to be supplied to die cutter 20. Front start/stop control 406 and rear start/stop control 408 each have a safety interlock switch 412 and 414, respectively. Both safety interlock switches 412 and 414 must be in the "on" position before die cutter 20 can be activated. With master power switch 410 in the "on" position, and with both safety interlock switches for 412 and 414 in the "on" position, die cutter 20 can be activated by pressing one of the start switches 416 and 418 on the front or rear start/stop controls 406 or 408. The belts 278 and 334, and rollers 60 and 62, will move in the direction determined by whichever of the sensors 304 or 382 senses presence of a die. If front sensor 304 senses a presence of a die, die cutter 20 operates in a rearward direction, and if rear sensor 382 senses the presence of a die, the die cutter 20 operates in a forward direction.

Assuming that die is on front table 24, tripping sensor 304, when the die cutter 20 is activated the belts 278 and 334, and rollers 60 and 62 will operate toward the rear, and continue to operate. When the actuator arm 386 of sensor 382 is tripped by the die, the sensor 382 causes the die cutter to stop. Central control unit 404 has a first delay means with a control 422 for selecting the delay period. At the expiration of the pre-selected delay period, the control 204 reactivates the die cutter 20, since sensor 382 still senses a die on reactivation, the die cutter operates in the forward direction. Once reactivated, belts 278 and 334, and rollers 60 and 62 continue to operate toward the front. When the actuator arm 308 of sensor 304 is tripped by a die, the sensor 304 causes the die cutter 20 to stop. Central control unit 404 has a second delay means with a control 424 for selecting the delay period. At the expiration of the second delay the central control 204 reactivates die cutter 20. Since sensor 304 still senses a die on the die cutter, operation is in the rearward direction. Once reactivated, belts 278 and 334, and rollers 60 and 62 operate toward the rear. Of course, the first and second delay means can be disabled so that die cutter 20 can be run in a manual mode. In this case, the die cutter 20 will always operate to move the die to the opposite table from the one where a sensor detects the die, stopping when the opposite sensor is tripped.

A die 450 is shown in FIGS. 1, 11, and 12 as comprising a backboard 452 and a plurality of raised cutting and scoring rules 454. Strippers 456 are provided on alternating sides of the rules 454. A blank is positioned over the die 450, and the die and blank are run through rollers 60 and 62 which push the blank into die 450, cutting and scoring the blank according to the die 450.

OPERATION

A die 450 is placed on the front table 24 on belts 278 in position to trip sensor 304. A blank is positioned over the die. The spacing between rollers 60 and 62 is adjusted for the particular die by operating crank 178 to raise or lower roller 62 to the appropriate height. The master power switch 410 is turned "on" to the position. The front and rear safety interlock switches 412 and 414 are operated to the "on" position. One of the start buttons 416 or 418 is pressed to start die cutter 20. Because sensor 304 detects the presence of a die 450 on the front table 24, the control unit 404 causes belts 278 and 334, and rollers 60 and 62 to move in the rearward direction. Belts 278 move the die 450 and blank to rollers 60 and 62. The die 450 and blank pass through the rollers 60 and 62, with rollers 60 pressing the blank into die 450, the cutting edges of the die 450 penetrating the cover 64 on roller 60. The belts 334 draw the die and cut blank away from roller 60 and 62 until the actuator arm 386 on sensor 382 is tripped by die 450. The central control 404 then stops die cutter 20. The delay means set by control 422 is activated by the tripping of sensor 382. At the end of the delay, the central control 404 reactivates die cutter 20, and because a sensor 382 senses the presence of a die 450 on the rear table 26, the central control 404 reverses the die cutter 20 and belts 334 move the die 450 and blank forward to rollers 60 and 62. The rollers 60 and 62 push the die and blank therethrough. The belts 278 draw the die and cut blank forward from rollers 60 and 62 until the actuator arm 308 on sensor 304 is tripped by die 450. The control means 404 then stops die cutter 20. The delay means set by control 424 is activated by sensor 304. At the end of the delay set by control 424, control 404 reactivates the die cutter 20 in the rearward direction.

The delay at front table 24 of the die cutter is preferably set long enough so that an operator can remove the cut blank and replace it with an uncut blank. The delay on the rear table can be set at zero to simply return the die or longer than zero to allow an operator to remove the cut blank before the die is returned to the front table, or even longer to allow an operator at the rear table to allow the operator to remove the cut blank and replace it with an uncut blank so that a cut is made with each pass through rollers 60 and 62. Of course, both delays can be turned off and the die cutter 20 operated manually. In this case, whichever sensor 304 or 382 is being tripped when the die cutter 20 is activated determines which direction control unit 404 will cause die cutter 20 to operate.

There are various changes and modifications which may be made to inventor's invention as would be apparent to those skilled in the art. However, these changes or modifications are included in the teaching of inventor's disclosure, and it is intended that the invention be limited only by the scope of the claims appended hereto.

We claim:

1. A die cutter for cutting a blank of a sheet material against a die comprising a backboard having upwardly facing cutting edges, the die cutter comprising:

a first roller and means for driving the first roller;

a second roller mounted parallel to the first roller and spaced therefrom, and, means for driving the second roller oppositely of the first;

a first feed means for conducting the die to the rollers, the rollers drawing the die therethrough and pressing the die;

second feed means for conducting the die from the rollers, and means to permit at least one roller to slip to accomodate dies passing between the first and second rollers;

the first and second rollers being vertically opposing, with the second roller above the first roller, the first feed means positioned in front of the rollers and the second feed means positioned in the rear of the rollers;

the die cutter further comprising a first sensor means for sensing when a die is on the rearward side of the roller; and means responsive to the first sensor means for stopping the first and second feed means and the rollers.

2. The die cutter of claim 1 wherein the first roller and the first and second feed means are all driven at the same speed.

3. The die cutter of claim 2 wherein the first and second feed means are driven by the first roller.

4. The die cutter of claim 1 wherein the means for driving the second roller includes means for allowing the second roller to slip to accommodate dies passing between the first and second rollers.

5. The die cutter of claim 4 wherein the second roller is frictionally driven from the first roller.

6. The die cutter of claim 1 further comprising means for adjusting the spacing between the rollers while mounting the rollers generally parallel to each other.

7. The die cutter of claim 6 wherein the means for adjusting spacing comprises means for simultaneously, selectively raising or lowering both ends of the second roller.

8. The die cutter of claim 1 further comprising a first delay means, the delay means activated when the first sensor means senses a die on the rearward side of the rollers, the delay means causing a preselected delay; and, means for activating the first and second feed means and the rollers at the end of the delay to move forward.

9. The die cutter of claim 8 wherein the preselected delay of the first delay means is adjustable.

10. The die cutter of claim 8 further comprising a second sensor means for sensing when a die is on the front side of the rollers, and means responsive to the second sensor means for stopping the first and second feed means and the rollers.

11. The die cutter of claim 10 further comprising a second delay means, the delay means activated when the second sensor means senses a die on the front side of the rollers, the delay means causing a preselected delay; and, means for activating the first and second feed means and the rollers at the end of the delay, to move rearwardly.

12. A die cutter for cutting a blank of sheet material against a die comprising a backboard having upwardly facing cutting edges, the die cutter comprising:

a frame;

a first roller, means for rotatably mounting the first roller in the frame, and means for driving the first roller;

a second roller, means for mounting the second roller in the frame vertically above and generally parallel to and spaced from the first roller, said mounting means including means for simultaneously, selectively raising the ends of the second roller to adjust the spacing between the rollers while maintaining the rollers generally parallel to each other, and means for frictionally driving the second roller from the first roller to allow stoppage therebetween;

a first feed means in front of the rollers operable rearward to feed the rollers and forward from the rollers for conducting a die to and from the rollers;

a second feed means in the rear of the rollers operable rearward for conducting a die from the rollers, and forward to the rollers;

means for driving the first and second feed means from the first roller, the die cutter operable rearward with the first and second means and the roller moving rearward and forward with the first and second feed means and the roller a die forward;

the die cutter further comprising a first sensor means for sensing when a die is on the rearward side of the rollers; and means responsive to the first sensor means for stopping the first and second feed means and the rollers.

13. The die cutter of claim 12 further comprising a first delay means, the delay means activated when the first sensor means senses a die on the rearward side of the rollers, the delay means causing a preselected delay; and, means for activating the first and second feed means and the rollers at the end of the delay to move forward.

14. The die cutter of claim 13 wherein the preselected delay of the first delay means is adjustable.

15. The die cutter of claim 13 comprising a second sensor means for sensing when a die is on the front side of the rollers, and means responsive to the second sensor means for stopping the first and second feed means and the rollers.

16. The die cutter of claim 15 further comprising a second delay means, the delay means activated when the second sensor means senses a die on the front side of the rollers, the delay means causing a preselected delay; and, means for activating the first and second feed means and the rollers at the end of the delay, to move rearwardly.

* * * * *

UNITED STATES PATENT AND TRADEMARK OFFICE

CERTIFICATE OF CORRECTION

PATENT NO. : 4,643,062

DATED : February 17, 1987

INVENTOR(S) : James H. Highfield

It is certified that error appears in the above-identified patent and that said Letters Patent is hereby corrected as shown below:

Column 10, line 13 add --moving-- between "roller" and "a die "

Column 10, line 30 add --further-- between "claim 13" and "comprising"

Signed and Sealed this

Eighteenth Day of August, 1987

*Attest:*

*Attesting Officer*

DONALD J. QUIGG

*Commissioner of Patents and Trademarks*